US007410053B2

(12) United States Patent
Bowen et al.

(10) Patent No.: US 7,410,053 B2
(45) Date of Patent: Aug. 12, 2008

(54) LAYERED TOOL HOLDER WITH VISIBLE IDENTIFICATION

(75) Inventors: Michael L Bowen, Mansfield, TX (US); Robert E Delk, Mansfield, TX (US)

(73) Assignee: Advanced Materials Group, Inc., Dallas, TX (US)

( * ) Notice: Subject to any disclaimer, the term of this patent is extended or adjusted under 35 U.S.C. 154(b) by 116 days.

(21) Appl. No.: 11/263,088

(22) Filed: Oct. 31, 2005

(65) Prior Publication Data

US 2006/0091031 A1 May 4, 2006

Related U.S. Application Data

(60) Provisional application No. 60/623,924, filed on Nov. 1, 2004.

(51) Int. Cl.
*B65D 85/20* (2006.01)

(52) U.S. Cl. ..... 206/373; 206/370; 206/459.5

(58) Field of Classification Search ..... 206/349–382, 206/459.5, 460, 813
See application file for complete search history.

(56) References Cited

U.S. PATENT DOCUMENTS

| | | | | |
|---|---|---|---|---|
| 4,076,116 | A | 2/1978 | Sowders | |
| 4,182,448 | A * | 1/1980 | Huck et al. | 206/813 |
| 4,327,136 | A | 4/1982 | Thompson et al. | |
| 4,344,532 | A * | 8/1982 | Eldridge et al. | 206/370 |
| 4,702,377 | A | 10/1987 | Grone | |
| 4,736,843 | A | 4/1988 | Leonard | |
| 4,779,729 | A | 10/1988 | Aoyama | |
| 4,964,514 | A | 10/1990 | Wyecech | |
| 5,320,223 | A | 6/1994 | Allen | |

* cited by examiner

*Primary Examiner*—Bryon P Gehman
(74) *Attorney, Agent, or Firm*—Howison & Arnott, L.L.P.

(57) ABSTRACT

A tool holder formed from two or more layers of material is provided. Cutouts or pockets may be formed in the tool holder corresponding with specific types and sizes of tools. An identification for each tool may be provided on the tool holder adjacent to each cutout. The identification remains visible to a reader when an associated tool is placed in each respective cutout.

23 Claims, 3 Drawing Sheets

LAYERED TOOL HOLDER WITH VISIBLE IDENTIFICATION

RELATED APPLICATION

This application claims priority to U.S. Provisional Patent Application Ser. No. 60/623,924, filed Nov. 1, 2004 and entitled "TOOL HOLDER," the contents of which are hereby incorporated in their entirety by reference.

TECHNICAL FIELD

The present invention is related to tool holders having cutouts or pockets shaped to receive a specific size and type of tool and more particularly to tool holders formed from two or more layers of material.

BACKGROUND OF THE INVENTION

Tool boxes and tool chests frequently hold a wide variety of tools and other devices. Tool boxes and tool chests may include one or more drawers for specific types of tools. Such tool boxes and tool chests may include molded plastic inserts sized to receive specific sizes and types of tools. The type and/or size of the tool contained within each drawer may be printed on the exterior of the drawer. Also, the type and/or size of each tool may be printed on the molded plastic insert contained within the drawer.

Many industries call for the use of unique tools which are not compatible with large volume commercially available tool boxes and tool drawers. These industries often place a high premium on keeping track of valuable tools and ensuring that all tools are fully accounted for at the end of a work process, work shift or work day. For example, during repair and assembly of a jet engine, checklists and associated procedures are required for accounting for all tools after completion of a repair and assembly. The same requirements often apply to repair of complex systems such as electrical power generating equipment, nuclear reactors, etc. Foreign object debris or foreign object damage (FOD) is a well known problem associated with operation of jet engines and similar types of equipment.

Positive control of expensive tools and associated tooling has become an important part of modern industry. The United States government and similar organizations typically have procedures and requirements for positive control of tools and tooling.

SUMMARY OF THE INVENTION

In accordance with teachings of the present invention, a tool holder and method of forming a tool holder are provided to overcome many of the shortcomings and disadvantages associated with prior tool holders. One aspect of the present invention includes providing a tool holder which may be fabricated at relatively low cost from two or more layers of material. Tool holders formed in accordance with teachings of the present invention may be used to substantially reduce or eliminate foreign object debris or foreign object damage (FOD) after repair and maintenance of complex equipment such as jet engines and large water pumps. Such tool holders may be used in a wide variety of industries from aircraft maintenance to nuclear reactor repair to complex surgical procedures to ensure that all tools and other objects have been accounted for after completion of an associated procedure.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Preferred embodiments of the invention and its advantages are best understood by reference to FIGS. 1-6 wherein like numbers refer to same and like parts.

The term "tool holder" may be used in this application to describe any type of component or assembly formed in accordance with teachings of the present invention satisfactory for holding tools, tooling, devices or any other objects.

Figure 1:
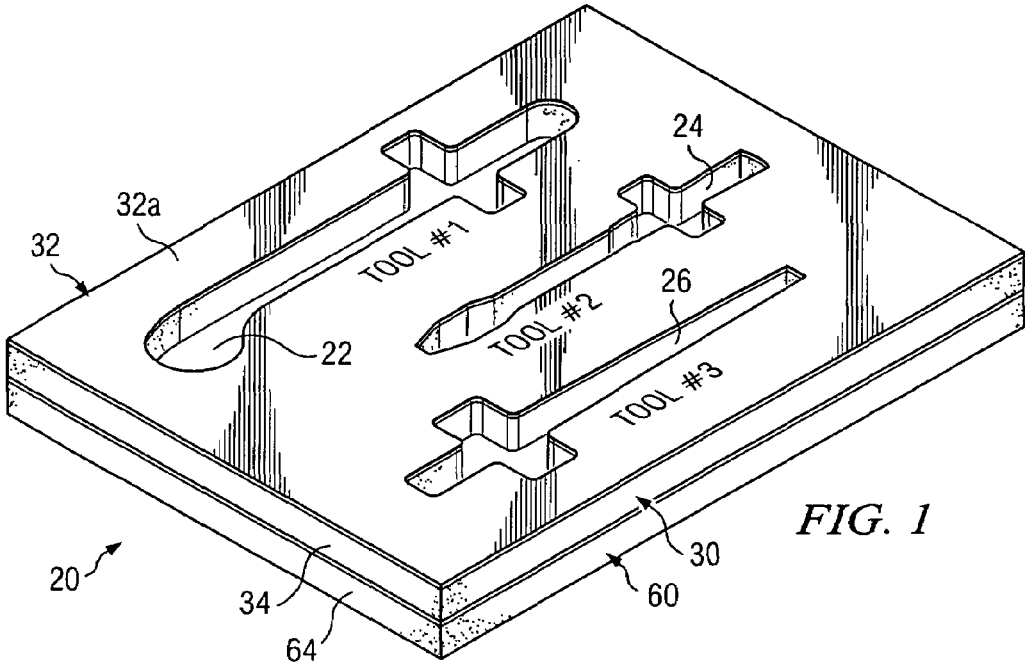
FIG. 1 is a schematic drawing showing an isometric view of one example of a tool holder incorporating teachings of the present invention.
Figure 2:
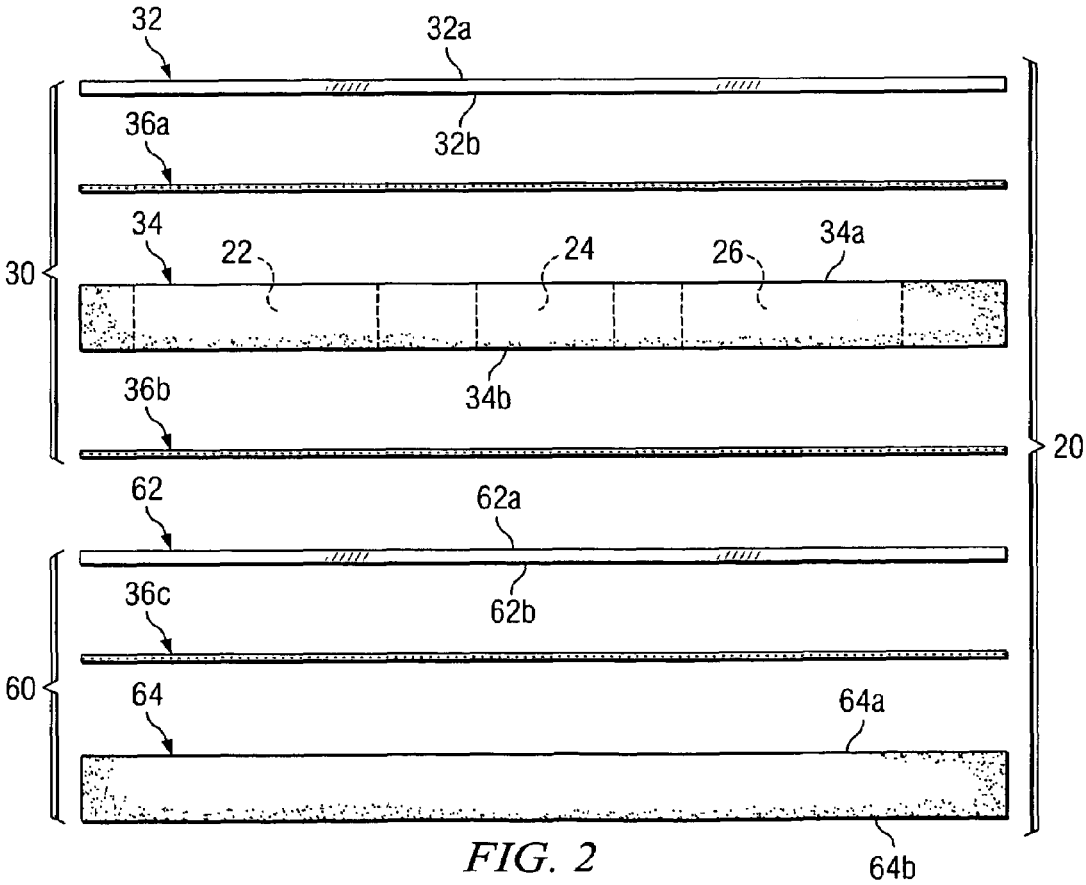
FIG. 2 is a schematic drawing showing an exploded, side view of a tool holder formed in accordance with teachings of the present invention.

Tool holder 20 may be formed from multiple layers of material in accordance with teachings of the present invention. Tool holder 20 and associated layers of material may be formed in accordance with teachings of the present invention having various configurations including square, rectangular, triangular, circular, oval or any other satisfactory configuration. Multiple cutouts or pockets may be formed in tool holder 20 to receive respective tools or other devices. For example, cutouts 22, 24 and 26 as shown in FIG. 1 may be formed in tool holder 20 to receive respective tools (not expressly shown) having corresponding dimensions and configurations.

Figure 4:
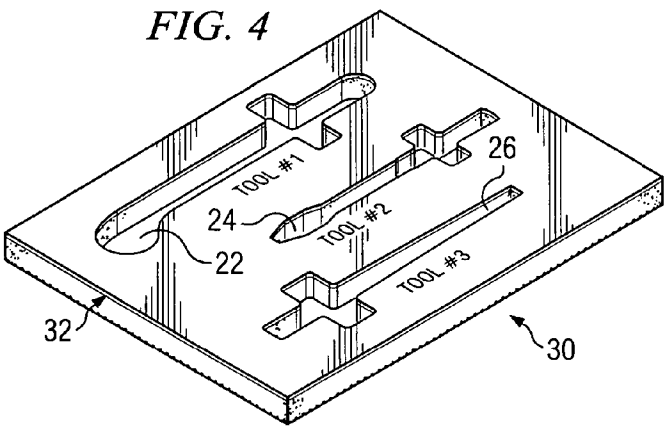
FIG. 4 is a schematic drawing in sections showing portions of a tool holder formed from the manufacturing blank of FIG. 3.
Figure 6:
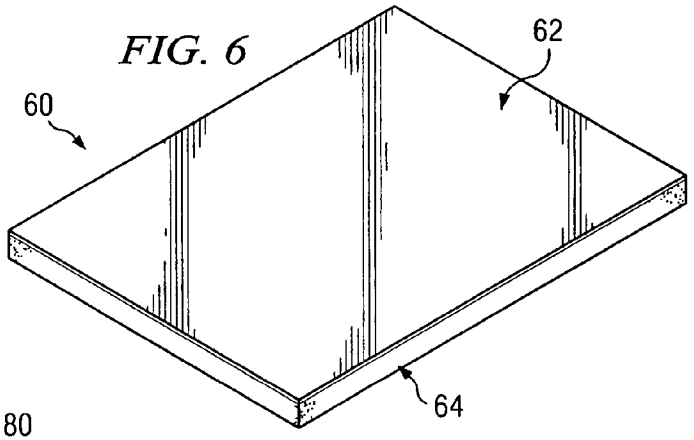
FIG. 6 is a schematic drawing in section showing portions of a tool holder formed from the manufacturing blank of FIG. 5.

For some applications tool holder 20 may have two components or subassemblies designated as 30 and 60. First component or upper component 30 may be formed from two or more layers of material. Second component or lower component 60 may also be formed from two or more layers of material. First component or upper component 30 is also shown in FIG. 4. Second component or lower component 60 is also shown in FIG. 6.

Embodiments such as shown in FIGS. 1-6 may include first component or upper component 30 having first layer 32 formed from relatively tough, clear material and second layer 34 formed from relatively lightweight foam. For some applications second layer 34 may have a thickness substantially greater than the thickness of layer 32.

Embodiments such as shown in FIGS. 1-6 may include second component or lower component 60 having layer 62 formed from relatively tough, clear material and layer 64 formed from relatively lightweight foam. For some applications layer 64 may have a thickness substantially greater than the thickness of layer 62. Adhesive material 36*a*, 36*b* and 36*c* may be respectively disposed between and bonded with layers 32 and 34, layers 34 and 62 and layers 62 and 64. See FIG. 2.

For some tool holders, layers 32 and 62 may be formed from the same material. For other applications layers 32 and 62 may be formed from different materials. In a similar manner, layers 34 and 64 may be formed from the same material. For other applications layers 34 and 64 may be formed from different materials. For example, layers 32 and/or 62 may be formed from clear plastic film or sheets of polyester film and polycarbonate, polyethylene and polypropylene. Mylar® films from DuPont may be used for some applications. Layers 34 and 64 may be formed from closed cell cross-linked polyethylene foam. A wide variety of other materials may be satisfactorily used to form layers 32, 34, 62 and 64.

First layer 32 preferably includes first surface 32*a* and second surface 32*b*. A name corresponding with a tool that may be placed in each cutout 22, 24 and 26 is preferably imprinted on the reverse side or second surface 32*b* of layer 32. The location of the name for each cutout 22, 24 and 26 may be placed on second surface 32*b* at a location proximate the desired location for forming the respective cutouts 22, 24 and 26. Each name is preferably visible even when an appropriate tool is placed in respective cutout 22, 24 and 26. For some applications the names may be imprinted on first surface 32*a*. Adhesive material 36*a*may be disposed between layers 32 and 34.

Second layer 34 preferably includes first surface 34*a* and second surface 34*b*. Adhesive material 36*b* may be disposed on second surface 34*b*. Release liner 38 may be attached with adhesive material 36*b* opposite from second surface 34*b* prior to assembly of first component 30 with second component 60. Layer 62 of second component 60 includes first surface 62*a* and second surface 62*b*. In a similar manner, layer 64 includes first surface 64*a* and second surface 64*b*. See FIG. 2.

Various procedures and techniques may be satisfactorily used to form tool holders from two or more layers of material in accordance with teachings of the present invention. For some applications relatively long, thin strip of clear plastic film 132 and relatively long strip of plastic foam 134 may be used to form multiple upper components 30. See FIG. 3. In a similar manner relatively long, thin strip of clear plastic film 162 and relatively long strip of plastic foam 164 may be used to form multiple lower components 60. See FIG. 5.

Figure 3:
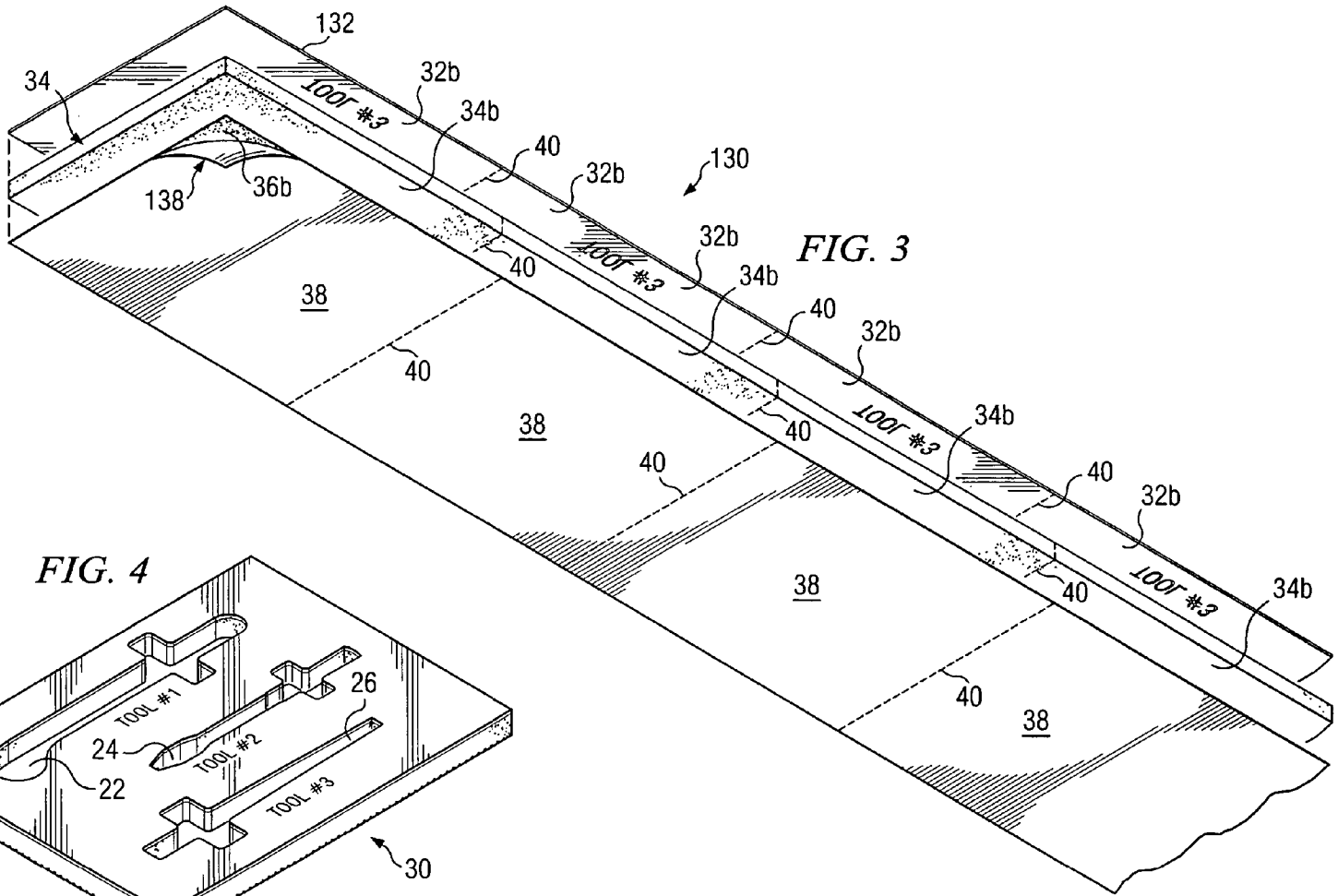
FIG. 3 is a schematic drawing showing an isometric, exploded view with portions broken away of multiple layers of material forming an elongated blank in accordance with teachings of the present invention.

For embodiments such as those shown in FIG. 3, clear plastic film strip 132 may be formed with a width corresponding with the desired width for each top layer or first layer 32. The length of strip 132 may be selected to correspond with the number of top layers 32 which will be formed therefrom. Also, respective tool names for each cutout which will later be formed in top layer 32 may be preprinted at appropriate locations corresponding with respective second surfaces 32*b*. See FIG. 3.

Foam strip 134 may be formed with approximately the same width as clear plastic film strip 132. The length of foam strip 134 may be approximately equal to the length of clear plastic film strip 132. Various techniques such as heat sealing, sonic bonding and/or adhesive bonding may be satisfactorily used to attach plastic strip 132 with foam strip 134. For example, adhesive material 36*a* may be used to attach layer 32 with layer 34.

Adhesive material 36*b* may be disposed on one side of foam strip 134 which will correspond with second side 34*b* of respective second layers 34. Release liner strip 138 may be attached with adhesive material 36*b*. Plastic strip 132, foam strip 134, adhesive material 36*b* and release liner strip 138 may be bonded with each other to form elongated manufacturing blank 130. See FIG. 3. Elongated manufacturing blank 130 may be cut at respective dotted lines 40 to form individual manufacturing blanks corresponding with each upper component 30. For some applications clear plastic film strip 132, foam strip 134 and release liner strip 138 may be taken from substantially continuous rolls for each type of material.

Cutouts 22, 24 and 26 may be formed in respective portions of clear plastic strip 132 and foam layer 134 prior to cutting individual manufacturing blanks corresponding with each upper component 30. For other applications, individual manufacturing blanks with dimensions corresponding with upper component 30 may be cut from elongated manufacturing blank 130 prior to forming cutouts 22, 24 and 26.

For some applications, cutouts 22, 24 and 26 may extend through clear plastic layer 32 and foam layer 34. Depending upon the type of cutting procedure used, release liner 38 may remain intact (kiss cutting) or portions of release liner 38 may also be cut out during the same process. For some applications, cutouts 22, 24 and 26 may only extend partially through foam layer 34. For such applications it may not be necessary to attach second component or lower component 60 with first component or upper component 30. First components 30 may function satisfactorily as a tool holder depending upon the amount of material remaining at the bottom of each cutout.

Figure 5:
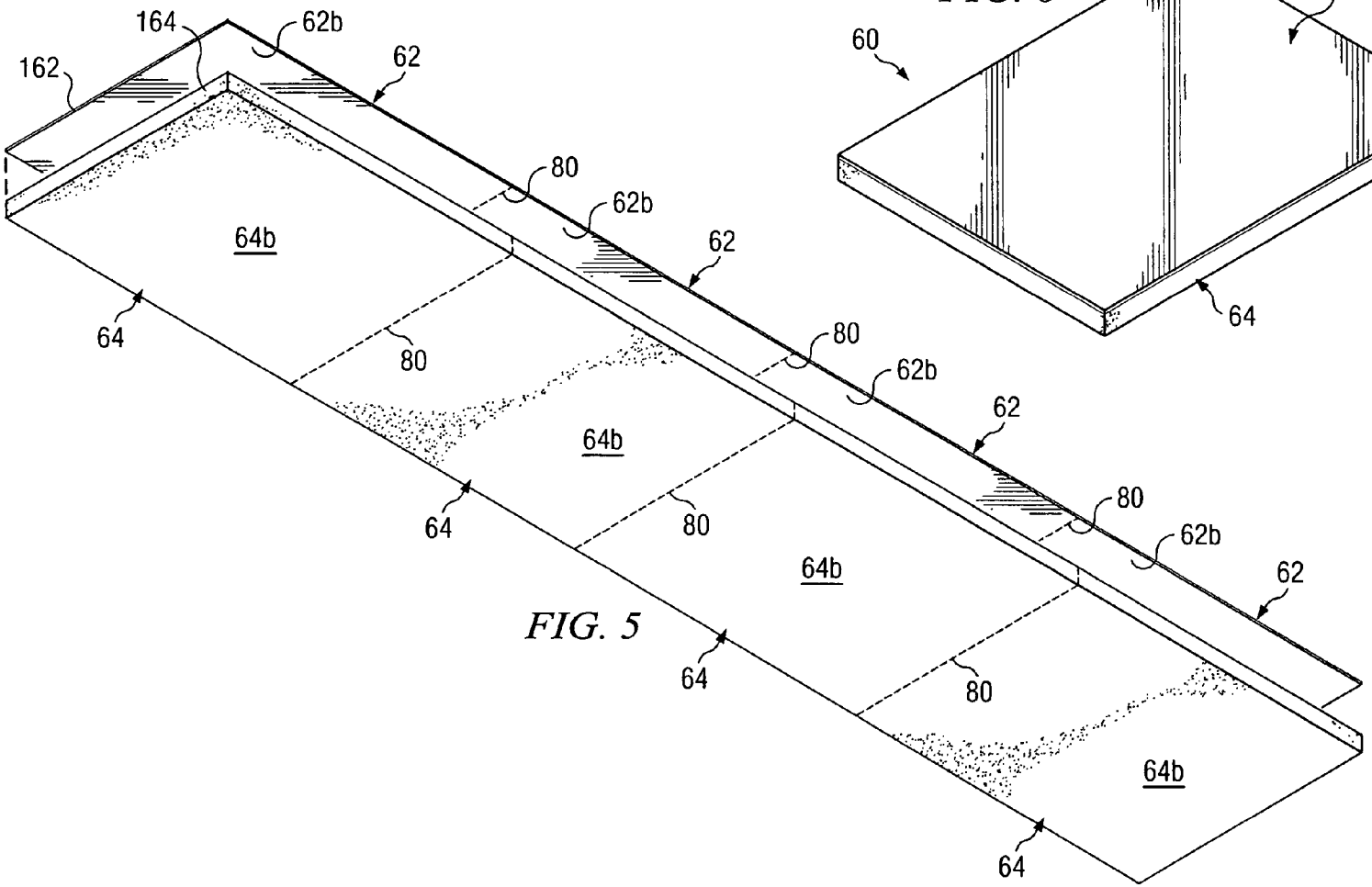
FIG. 5 is a schematic drawing showing an isometric, exploded view with portions broken away of multiple layers of material forming an elongated, manufacturing blank in accordance with teachings of the present invention.

For embodiments such as shown in FIG. 5, clear plastic film strip 162 may be formed with a width corresponding with the desired width for each layer 62. The length of strip 162 may be selected to correspond with the number of layers 62 which will be formed therefrom. Foam strip 164 may be formed with approximately the same width as clear plastic film strip 162. The length of foam strip 164 may be approximately equal to the length of clear plastic film strip 162. Various techniques such as heat sealing, sonic bonding or adhesive bonding may be satisfactorily used to attach plastic strip 162 with foam strip 164 to form elongated manufacturing blank 160. For example, adhesive material 36*c* may be used to attach layer 62 with layer 64. Dotted lines 80 correspond with cuts which may be made in elongated manufacturing blank 60 to form corresponding second components 60.

After upper component 30, such as shown in FIG. 4, has been formed, release liner 38 may be removed from adhesive material 36*b*. Second surface 34*b* and associated adhesive material 36*b* of first component 30 may then be placed on first surface 62*a* of second component 60 to complete assembly of tool holder 20.

Alternative embodiments of the present invention may include attaching only layer 62 with second surface 34*b* of component 30, attaching only layer 64 with second surface 34*b* or using first component 30 as a tool holder without attaching any other layers to second surface 34*b*. For some applications, release liner 38 may be removed from second surface 34*b* and adhesive material 36*b* attached directly to the top of a work surface, the bottom of a tool drawer or any other desired location for storage of the tools which may be placed in cutouts 22, 24 and 26.

Although the present invention and its advantages have been described in detail, it should be understood that various changes, substitutions and alternations can be made herein without departing from the spirit and scope of the invention as defined by the following claims.

What is claimed is:

1. A tool holder formed from at least two layers of material comprising:

a first layer of tough, clear material;

a second layer of material having a thickness greater than the thickness of the first layer;

the first layer having a first surface and a second surface;

the second layer having a first surface and a second surface;

the second surface of the first layer disposed on and bonded with the first surface of the second layer;

one or more cutouts extending through the first layer and at least a portion of the second layer;

each cutout having a specific configuration and dimensions to accommodate an associated tool;

a respective identification for the associated tool printed on the second surface of the first layer adjacent to the respective cutout; and each identification visible through the first surface of the first layer.

2. The tool holder of claim 1 further comprising:

a third layer of material;

a fourth layer of material having a thickness greater than the thickness of the third layer;

the third layer having a first surface and a second surface;

the fourth layer having a first surface and a second surface;

the second surface of the second layer disposed on and bonded with the first surface of the third layer; and the second surface of the third layer disposed on and bonded with the first surface of the fourth layer.

3. The tool holder of claim 2 further comprising:

the first layer and the third layer formed from clear, plastic material.

4. The tool holder of claim 2 further comprising the second layer and the fourth layer formed from lightweight plastic foam.

5. The tool holder of claim 1 further comprising the first layer and the second layer having generally rectangular configurations.

6. The tool holder of claim 1 further comprising:

adhesive material disposed on the second surface of the second layer; and a release liner disposed on the adhesive material opposite from the first layer.

7. The tool holder of claim 1 further comprising each cutout extending from the first surface of the first layer through the second surface of the second layer.

8. A method for forming a tool holder having at least one cutout for a respective tool comprising:

attaching a first layer of material having a first thickness on a second layer of material having a second thickness greater than the first thickness of the first layer;

forming a layer of adhesive material on the second layer opposite from the first layer;

placing a release liner on the adhesive material opposite from the first surface of the second layer;

forming a cutout extending through the first layer and a least a portion of the second layer, each cutout having a specific configuration and dimensions to accommodate an associated tool; and forming the cutout adjacent to a corresponding tool identification on the first layer, each identification visible through a first surface of the first layer.

9. The method of claim 8 further comprising:

forming a third layer of material having a first surface and a second surface;

forming a fourth layer of material having a first surface and a second surface;

attaching the second surface of the third layer of material with the first surface of the fourth layer of material;

removing the release liner from the adhesive material on the second surface of the second layer of material; and attaching the first surface of the third layer of material with the adhesive material on the second layer of material.

10. The method of claim 9 further comprising:

forming a third elongated strip satisfactory for forming the third layer of the tool holder;

forming a fourth elongated strip satisfactory for forming the fourth layer of the tool holder;

attaching the third elongated strip with the fourth elongated strip; and cutting the combined elongated strips into a plurality of manufacturing blanks for use in forming respective tool holders.

11. The method of claim 8 further comprising:

forming a first elongated strip from material satisfactory for forming the first layer of the tool holder;

forming a second elongated strip of material satisfactory for forming the second layer of the tool holder;

attaching the first elongated strip with the second elongated strip; and cutting the combined elongated strips into a plurality of manufacturing blanks for use in forming respective tool holders.

12. The method of claim 8 further comprising forming the first layer from clear plastic film.

13. The method of claim 8 further comprising forming the first layer of material from clear plastic film with the tool identification printed on the second surface of the first layer.

14. The method of claim 8 further comprising forming the second layer of material from lightweight foam.

15. A tool holder formed from at least four layers of material comprising:

a first layer of tough, clear material;

a second layer of material having a thickness greater than the thickness of the first layer;

the first layer having a first surface and a second surface;

the second layer having a first surface and a second surface;

the second surface of the first layer disposed on and bonded with the first surface of the second layer;

one or more cutouts extending through the first layer and at least a portion of the second layer;

each cutout having a specific configuration and dimensions to accommodate an associated tool;

a respective identification for the associated tool printed on the second surface of the first layer adjacent to the respective cutout;

each identification visible through the first surface of the first layer;

a third layer of material of tough clear material;

a fourth layer of material having a thickness greater than the thickness of the third layer;

the third layer having a first surface and a second surface;

the fourth layer having a first surface and a second surface;

the second surface of the second layer disposed on and bonded with the first surface of the third layer; and the second surface of the third layer disposed on and bonded with the first surface of the fourth layer.

16. The tool holder of claim 15 further comprising the first layer and the second layer having generally rectangular configurations.

17. The tool holder of claim 15 further comprising adhesive material disposed on the second surface of the second layer.

18. The tool holder of claim 15 further comprising the first layer and the third layer formed from clear, plastic material.

19. The tool holder of claim 15 further comprising the second layer and the fourth layer formed from lightweight foam.

20. The tool holder of claim 15 further comprising each cutout extending from the first surface of the first layer through the second surface of the second layer.

21. A tool holder for holding tools specific to a selected trade, the tool holder comprising:

a first perforated sheet of tough, clear material and having a first surface and a second surface;

a first perforation of said first perforated sheet extending through said first perforated sheet and being shaped to hold a specific individual tool specific to the selected trade;

a second perforated sheet of semirigid foam having a first side and a second side, the second side of the first perforated sheet being disposed on and boded with the first surface of said second perforated sheet, said second perforated sheet having a thickness greater than the thickness of the first perforated sheet;

a second perforation extending through said second perforated sheet being of substantially the same shape of and aligned with the first perforation; and a third sheet of material having a first side and a second side, the first side being bonded to the second side of said second perforated sheet;

a respective identification for the specific individual tool specific to the selected trade printed on the second surface of the first perforated sheet adjacent to the respective first perforation, each identification being visible through the first surface of the first layer.

22. The tool holder of claim 21, wherein the third sheet is a tough material.

23. The tool holder of claim 21, wherein the third sheet is a semirigid foam material.

* * * * *